United States Patent [19]

Okinaka et al.

[11] 4,310,391

[45] Jan. 12, 1982

[54] ELECTROLYTIC GOLD PLATING

[75] Inventors: Yutaka Okinaka, Madison; Craig G. Smith, North Plainfield, both of N.J.

[73] Assignee: Bell Telephone Laboratories, Incorporated, Murray Hill, N.J.

[21] Appl. No.: 105,977

[22] Filed: Dec. 21, 1979

[51] Int. Cl.[3] ..... C25D 3/48; C25D 3/56; C25D 3/62; C25D 17/10

[52] U.S. Cl. ..... 204/46 G; 204/43 G; 204/290 F

[58] Field of Search ..... 204/46 G, 290 F, 43 G

[56] References Cited

U.S. PATENT DOCUMENTS

| | | | |
|---|---|---|---|
| 3,428,544 | 2/1969 | Bianchi et al. | 204/290 F |
| 3,491,014 | 1/1970 | Bianchi et al. | 204/290 F |
| 3,616,445 | 10/1971 | Bianchi et al. | 204/290 F |
| 3,632,496 | 1/1972 | Beer | 204/290 |
| 3,711,385 | 1/1973 | Beer | 204/59 |
| 4,067,783 | 1/1978 | Okinaka et al. | 204/46 G |

OTHER PUBLICATIONS

Cipris et al., Journal of Elect. Chem., vol. 73 (1976) pp. 125–128.

Reid et al., Gold Plating Tech. Electrochemical Publications Ltd. (1974) pp. 21–52.

Modern Electroplating, John Wiley & Sons, N. Y., Edited by F. A. Lowenheim, 2nd Ed. (1963) pp. 224–244.

*Primary Examiner*—Howard S. Williams

*Attorney, Agent, or Firm*—Walter G. Nilsen

[57] ABSTRACT

A particular type of electrode structure is described which is useful as a counter electrode in gold plating processes. The electrode surface comprises oxides of certain group eight elements and oxides of certain valve metals. A process for preparing the electrodes is also described. Such electrodes or anodes exhibit long life and reduced undesirable side reactions in the gold plating process. For example, consumption of buffer material is greatly reduced and formation of trivalent gold is reduced.

7 Claims, 2 Drawing Figures

ELECTROLYTIC GOLD PLATING

TECHNICAL FIELD

The invention is a process for electroplating gold. In particular, the invention is directed toward anodes useful in gold electroplating processes, and processes for making such anodes.

BACKGROUND OF THE INVENTION

Gold is used in a variety of industrial applications, both because of its pleasing luster and excellent electrical properties. In particular, it is extensively used as an electrical contact material because of its chemical stability and the fact that an insulating layer is not formed on the surface.

Because of the extensive use of gold and its increasing cost, considerable amount of work is being devoted towards improving gold electroplating processes. In particular, increased efficiency and plating speed is highly desirable. In most gold plating procedures, the gold is added in the form of a solution (i.e., a solution of $Au(CN)_2^-$) and the anode is non-consumable. In these procedures, the anode electrolyzes water with the formation of gaseous oxygen. Reducing the electrochemical potential for the electrolysis of oxygen is important for several reasons. First, it increases the efficiency of the process by reducing power consumption. Second, it reduces or eliminates a number of side reactions which are undesirable in the gold plating process. For example, reduction or elimination of the formation of trivalent gold is highly desirable. Trivalent gold reduces the efficiency of the gold plating process and makes uncertain predictions of gold plating thickness from plating current measurements. Reduction of the electrochemical potential for the electrolysis of water is often critical in maintaining a commercially viable high speed gold plating operation.

A variety of anodes have been described in the literature. Particular references are the following: U.S. Pat. No. 3,428,544 (Guiseppe Bianchi et al, issued Feb. 18, 1969); U.S. Pat. No. 3,491,014 (Guiseppe Bianchi et al, issued Jan. 20, 1970); U.S. Pat. No. 3,616,445 (Guiseppe Bianchi, issued Oct. 26, 1971); and Extended Abstracts of the Electrochemical Society Spring Meeting, Seattle, Washington, May 21–16, 1978, Volume 78–1, pps. 1202–1205. Also, a recently issued patent (U.S. Pat. No. 4,067,783 issued Jan. 10, 1978, Okinaka, et al) describes anodes useful in gold plating.

SUMMARY OF THE INVENTION

The invention is a gold electroplating process in which a particular type of electrode is used as a nonconsumable anode or counter electrode. A particular procedure is used to make the electrodes. The surface of the anode comprises oxides of two groups of metals. One group of metals contains certain group eight metals, namely iridium, ruthenium, rhodium, cobalt and nickel. The other group of metals are various valve metals, namely tantalum, niobium, hafnium and zirconium. Hafnium, niobium and tantalum are preferred with tantalum most preferred. With the group eight oxides, iridium is preferred because of performance, especially at high current densities. The preferred oxides exhibit lowest voltages for water electrolysis and longest life for the electrode. Also, part of the iridium can be replaced with cobalt or nickel without significantly affecting desirable properties, especially at lower current densities. This substitution significantly reduces the cost of electrodes. The process for making these electrodes involve impregnation of the surface of the electrode with a solution of the ions to be used (e.g., Ir and Ta) and then heat treatment in oxygen-containing astmosphere (usually air) at 375–500 degrees C. for at least five minutes. Preferred heat treatment temperature is 400–450 degrees C. This temperature range is sufficiently high to insure both conversion to the metal oxide and good binding to the substrate without excessive oxidation of the substrate particularly if titanium is used as the substrate. Complete conversion to the oxide is unusually important in gold plating processes since the cyanide solution rapidly dissolves metal ions not completely converted to the oxide. There is also evidence that a mixed oxide is formed in the 400 to 450 degree C. temperature range which increases catalytic activity and improves stability and lifetime. Also, such electrodes exhibit low polarization voltages and long life.

DETAILED DESCRIPTION

Figure 1:
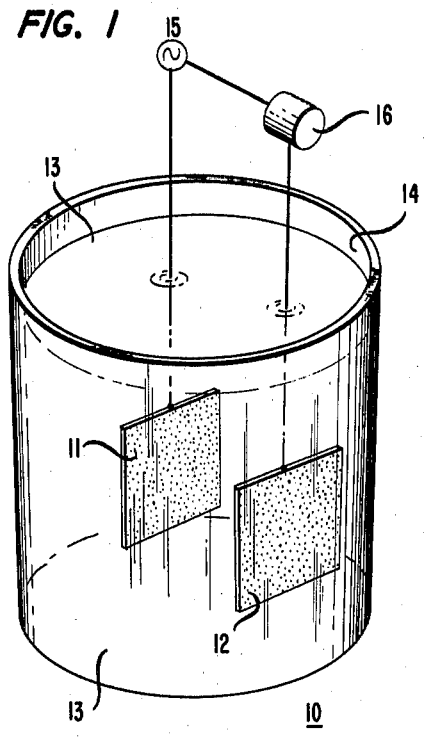
FIG. 1 shows a typical apparatus for carrying out a gold electroplating process, including anode and cathode.

The electrode is made up of a substrate and a surface coating of metal oxide. The substrate may be a substance that is compatible with the gold plating process. It should be chemically inert to the plating bath and sufficiently conductive to pass the current used in the plating process. Generally, the substrate is metallic. Typical substrates are made of titanium, niobium or tantalum or alloys of these metals. Particularly convenient is an alloy of niobium and tantalum.

The surface of the electrode is at least partly covered with a mixture of metal oxides. This mixture of oxides contains at least one metal oxide from two groups of metal oxides. The first group of oxides, which are referred to here as group eight metal oxides, are made up of oxides of iridium, ruthenium, rhodium, cobalt and nickel. The second group of metal oxides, referred to here as valve metal oxides are made up of oxides of tantalum, niobium, hafnium and zirconium.

Composition of the mixture of oxides may vary over wide limits and still provide useful results. Good results are obtained where the mole percent of group eight metal oxides vary from 15 to 90. Below 15 mole percent, the electrochemical potential for the electrolysis of water begins to rise; above 90 mole percent, the stability and lifetime of the electrode might become reduced. Best results are obtained with the group eight metal oxides between 30 or even 40 and 70 mole percent. It is believed that the valve oxides not only act as binders, but also enhance the catalytic activity of the group eight metal oxides. Although the reason for this is not known, a possible explanation is that there is some kind of cooperative action (i.e., chemical reaction) between the two kinds of oxides. Generally, extensive mixing together of the two kinds of oxides is preferred.

For the most part, iridium is preferred as the group eight metal. The percent of iridium oxide required for the very best results depends on the particular application. For gold plating baths in which citrate is used as the buffer and plating takes place at a temperature between 20–70 degrees C., (preferably 60–70 degrees C.), the very best results are obtained in which mole percent iridium oxide is 40±5% weight percent, remainder tantalum oxide.

In a gold plating bath in which phosphate is used as the buffer system and plating is carried out between 35–45 degrees C., an iridium oxide concentration between 60–70 mole percent, remainder tantalum oxide is most preferred. In other gold plating applications, the mole percent iridium should be adjusted to yield optimum results.

For many applications, part of the iridium oxide may be replaced by cobalt oxide or nickel oxide. Up to 70 mole percent of the iridium oxide may be replaced in this way. This is advantageous because it greatly reduces the cost of the electrode. Generally, using such an electrode increases slightly the electrochemical potential for the electrolysis of water. Where the current density is not extremely high (say, below 50 milliamps per $cm^2$) this is not likely to be disadvantageous. Also, in some gold electroplating baths, (for example, where concentration of trivalent gold is not critical), slightly increased electrochemical potential is not disadvantageous.

The electrodes may be produced by a variety of procedures. For example, the individual oxides can be made up, mixed together and glued to a substrate. The procedure described below is convenient and yields highly homogeneous mixtures of oxides. In addition, adherence to the substrate is extremely good which increases the lifetime of the electrode.

The procedure may be described in general terms as follows:

Metal oxide films are applied by dissolving chlorides of the metals in aqueous hydrochloric acid and alcohol. The substrate is then wetted (generally using a painting procedure) and then the chlorides are thermally converted to the oxide in air.

Two aspects of this procedure are of importance. First, the thermal treatment should be carried out in an oxygen-containing atmosphere (generally air and possibly oxygen enriched air) at a temperature between 375 and 500 degrees C. A temperature range of 400 to 450 degrees C. is preferred. This temperature range is sufficiently high to insure complete conversion to the oxide without excessive oxidation of the substrate. A treatment time of 15 minutes to 2 hours is preferred with 45 minutes to one hour most preferred.

Second, rapid heating to the temperature range of the thermal treatment is preferred. Specifically, it is preferred that the electrode being thermally treated be treated (from room temperature) to the temperature range of thermal treatment within 5 minutes. This can be done in a variety of ways. For example, a pre-heated metal block (aluminum or copper block) may be used as a heat source to insure rapid heating.

A detailed procedure for the preparation of the anode is given below. In this procedure, a titanium substrate is used and the metal oxides are tantalum oxide and iridium oxide.

First, the substrate surface is prepared so as to remove foreign matter and oxides from the surface. This generally is done by dry honing the substrate surface.

Second, a coating solution is prepared as follows: A solution of iridium compound is prepared in a solvent which dissolves both iridium and tantalum compounds. Then a solution of a tantalum compound is prepared in a solvent which dissolves both the tantalum compound and iridium compound. The two solutions are mixed together in a proportion desired for the electrode coating.

A specific procedure for preparation of the coating solution might be useful in understanding the invention. The volume of solution required depends on the area of electrode to be covered. Best results are obtained with a volume of 0.083 ml/sq cm of electrode area to be covered. The final solution is made in two parts so that one half of the volume is required for each part.

For citrate buffered gold plating baths where plating is carried out at 20–70 degrees C., the mole ratio of iridium to tantalum is 0.4. For the phospate buffered gold plating procedure, the mole ratio is 0.65.

The solution of iridium compound is made by dissolving iridium tetrachloride in (20 weight percent) hydrochloric acid at 70 degrees C. For anodes to be used in citrate buffered gold plating baths with a plating temperature of 20–70 (preferably 60–70) degrees C. concentration of iridium tetrachloride is 0.016 g/ml. For phosphate baths used at 40 degrees C., the preferred concentration is 0.020 g/ml. After the iridium tetrachloride is dissolved, the solution is allowed to cool.

The solution of tantalum compound is made by dissolving tantalum pentachloride in methanol. The tantalum pentachloride should be added slowly to prevent splattering and the solution stirred rapidly. Anodes for use in the 65 degree C. citrate bath should preferably have a concentration of 0.022 g/ml tantalum pentachloride; for the 40 degree C. phosphate bath, the preferred concentration is 0.009 g/ml tantalum pentachloride.

It is preferred that the solutions are prepared immediately before the coating procedure. The solutions are mixed together and cooled. The container holding the solution should be covered to prevent evaporation of the methanol.

Immediately before applying the coating, the surface of the substrate is etched with acid (preferably hydrochloric acid for fifteen minutes) and then dried. The substrate is then exposed to or soaked in the solution of metal compounds prepared above. The electrode surface is then dried generally in a hood to provide adequate ventilation. A heat gun or other source of heat may be used. It is preferred that drying be reasonably slow, say at least one minute. This soaking and drying procedure is repeated a number of times to ensure a reasonably thick coating of metal oxides. The substrate is then baked for a short time (5 to 30 minutes) at approximately 400 degrees C. and then cooled rapidly to room temperature. A cold metal block may be used to affect rapid cooling.

This procedure may be repeated a number of times in order to build up the thickness of the metal oxide mixture on the surface of the electrode. After sufficient thickness is obtained, the electrode is baked in air for approximately one hour at 400 degrees C.

FIG. 1 shows a typical gold plating apparatus 10 useful for gold plating small items and as an experimental set up for testing various parts (i.e., plating solution, electrode, etc.) of gold plating apparatus. The plating apparatus 10 is made up of anode or counter electrode 11 made in accordance with the invention, and cathode on which the gold is electroplated. Also shown is the plating bath 13 and container 14 for the plating bath. There is an electric power source 15 for the electroplating process and a current limiting apparatus 16 (generally a variable resistor) to control the plating process.

Figure 2:
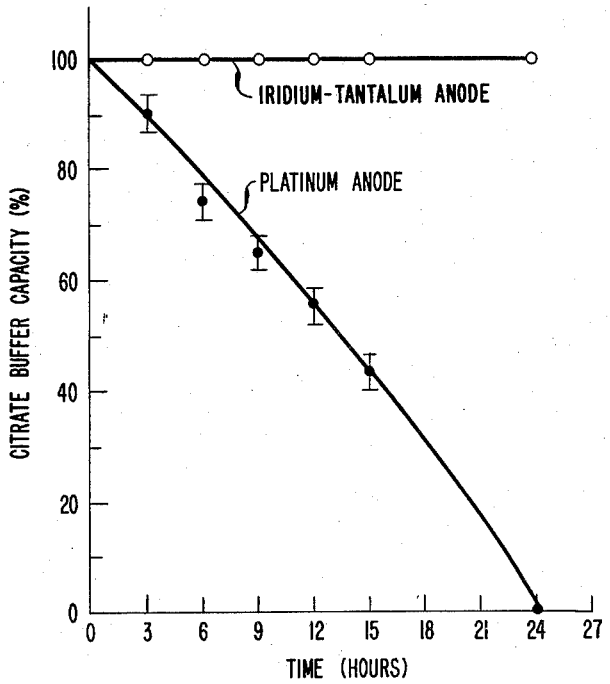
FIG. 2 shows a plot of buffer capacity versus time where a conventional platinum and iridium-tantalum anode are used.

FIG. 2 shows in quantitative terms another advantage of these anodes, namely, that there is significantly less degradation of the buffer solution. For a typical platinum anode, buffer capacity decrease rapidly during gold plating, whereas buffer capacity remains practically constant under the same conditions when an iridium-tantalum oxide anode is used. Also observed is the fact that these electrodes have lower potentials for the evolution of oxygen than conventional (platinum) electrodes and much reduced formation of trivalent gold.

What is claimed is:

1. A process for electroplating gold including the step of passing current through an anode, plating solution and cathode characterized in that at least part of the surface of the anode comprises an active oxide coating consisting essentially of 15 to 90 mole percent of at least one metal oxide from group eight metals, said group eight metals selected from the group consisting of iridium and rhodium, remainder tantalum oxide.

2. The process of claim 1 in which the active oxide coating consists essentially of 30 to 70 mole percent group eight metal oxide, remainder valve metal oxide.

3. The process of claim 1 in which the active oxide coating consists essentially of 40 to 70 mole percent group eight metal oxide, remainder valve metal oxide.

4. The process of claim 1 in which the group eight metal is iridium.

5. The process of claim 4 in which the plating solution comprises citrate buffer, the gold electroplating process is carried out in the temperature range from 20–70 degrees C. and the active oxide coating consists essentially of 40±5 mole percent iridium oxide, remainder tantalum oxide.

6. The process of claim 4 in which the plating solution comprises phosphate buffer, the gold electroplating process is carried out in the temperature range from 35 to 45 degrees C. and the active oxide consists essentially of 60–70 mole percent iridium oxide remainder tantalum oxide.

7. The process of claim 1 in which the group eight metal oxide is iridium oxide and the valve metal oxide is tantalum oxide.

* * * * *